United States Patent [19]

Mitchell

[11] Patent Number: 4,729,425

[45] Date of Patent: Mar. 8, 1988

[54] COOLING BLADDER ASSEMBLY FOR MIXING MILL

[76] Inventor: Phillip G. Mitchell, P.O. Box 612, 215 Orr Ave., Opelika, Ala. 36801

[21] Appl. No.: 853,671

[22] Filed: Apr. 18, 1986

[51] Int. Cl.[4] ..... F28F 3/12; F28F 7/00; B01F 15/06

[52] U.S. Cl. ..... 165/47; 165/76; 165/169; 366/149

[58] Field of Search ..... 165/47, 109.1, 169, 165/76, 46; 366/149

[56] References Cited

U.S. PATENT DOCUMENTS

| | | | |
|---|---|---|---|
| 1,024,936 | 4/1912 | Heller | 366/149 |
| 2,274,220 | 2/1942 | Sticelber | 366/149 |
| 3,317,958 | 5/1967 | Stroup et al. | 366/149 |
| 3,730,262 | 5/1973 | Drugmand | 165/46 |
| 4,497,365 | 2/1985 | Boyer | 165/169 |
| 4,635,710 | 1/1987 | Shelley | 165/171 |

FOREIGN PATENT DOCUMENTS

| | | | |
|---|---|---|---|
| 2237166 | 2/1975 | France | 165/169 |
| 348844 | 9/1972 | U.S.S.R. | 165/169 |

*Primary Examiner*—William R. Cline
*Assistant Examiner*—John K. Ford
*Attorney, Agent, or Firm*—Hurt, Richardson, Garner, Todd and Cadenhead

[57] ABSTRACT

Cooling-bladder assembly for installation around the mixing chamber of a sandmill or the like is provided having a pair of semi-circular bladder halves with inner and outer walls for defining an enclosure. Inlet and outlet ports connected to a suitable pump circulate coolant fluid through the enclosure, the bladder halves being secured together at the opposed vertical edges. Spacers in the form of hollow pipe section are connected to the inner and outer walls of the bladder for maintaining the integrity of the enclosure and for creating turbulence in the coolant fluid. A heat transfer or conductive paste may be applied to the outer wall of the mixing vessel or to the adjacent inner wall of the bladder to facilitate the transfer of heat from the sandmill mixing vessel to the bladder assembly.

7 Claims, 3 Drawing Figures

COOLING BLADDER ASSEMBLY FOR MIXING MILL

BACKGROUND OF THE INVENTION

1. Field of the Invention

This invention relates to an apparatus designed to mix various substances, normally liquids, and more particularly to a cooling bladder assembly for cooling the mixing chamber vessel.

2. Description of the Prior Art

A sandmill is a type of apparatus used for stirring and mixing various substances, for example, paints, clay/-water mixtures, and the like, in which particulate material such as glass beads or shot is added to the liquid or slurry for breaking up and dispersing the components to be mixed. The shot or beads are then filtered out of the mixture for re-use, leaving the mixed substance.

Such an operation generates substantial amounts of heat in the mixing chamber, the heat generated being deleterious both to the chamber assembly and to the mixture inside the chamber. Thus, most mills of this type have an integral cooling jacket surrounding the actual mixing chamber, through which water or other coolant is circulated. The jacket is permanently fixed to the mixing chamber and extends circumferentially around the chamber, normally encompassing the entire height of the chamber. This type of arrangement permits cooling of the inner chamber but affords no fine control of the cooling operation due to the continuity of the cooling jacket. Such fine control is desirable because the upper portions of the sandmill are normally hotter than the lower portions.

In addition, should repairs to the mixing chamber or cooling jacket become necessary, the entire apparatus must be disassembled for repairs or replacement. The operation is generally difficult because of the integral nature of the mixing chamber and jacket. This arrangement also risks contamination of the solution being mixed should a crack occur in the wall of the mixing chamber during operation. Similarly, faults in the water jacket which can not be repaired, require the replacement of the entire chamber/jacket assembly.

SUMMARY OF THE INVENTION

It is, therefore, one of the principal objects of the present invention to minimize component wear in devices such as sandmills by providing a cooling bladder assembly in which coolant may be circulated to dissipate heat generated by the mixing operation.

Another object of the present invention is to minimize downtime of the sandmill, the cooling provided by the present bladder assembly serving to permit essentially continuous operation of the mill between the loading and unloading of the chamber vessel.

A further object of the present invention is to provide a cooling bladder assembly in which the bladder is easily and quickly installed around the chamber vessel and which may be quickly and easily removed should repairs to the vessel or the bladder be required.

A still further object of the present invention is to provide a bladder assembly that can be installed without the need for special tools or training for the installers, and which is durable for providing a long service life.

These and additional objects are attained by the present invention which relates to a cooling bladder assembly for installation around the chamber vessel of a sandmill or similar device, and having a pair of bladder halves, each being a semicircular enclosure with an inner and an outer wall, the enclosure receiving coolant fluid. Inlet and outlet port means are provided and connected to a suitable source of circulation for pumping the fluid through the bladder halves. The bladder halves are secured around the mixing chamber at the opposing vertical edges where suitable securing means are used to provide a substantially full enclosure around the mixing chamber.

The bladder halves are normally composed of stainless steel and have spacer means disposed between the inner and outer walls for maintaining the integrity of the enclosure and for creating turbulence in the bladder. A heat-conductive paste will normally be applied to the mixing chamber to aid in heat transfer from the sandmill to the bladder.

Various additional objects and advantages will become apparent from the below description, with reference to the accompanying drawings.

DETAILED DESCRIPTION OF THE PREFERRED EMBODIMENT

Figure 1:
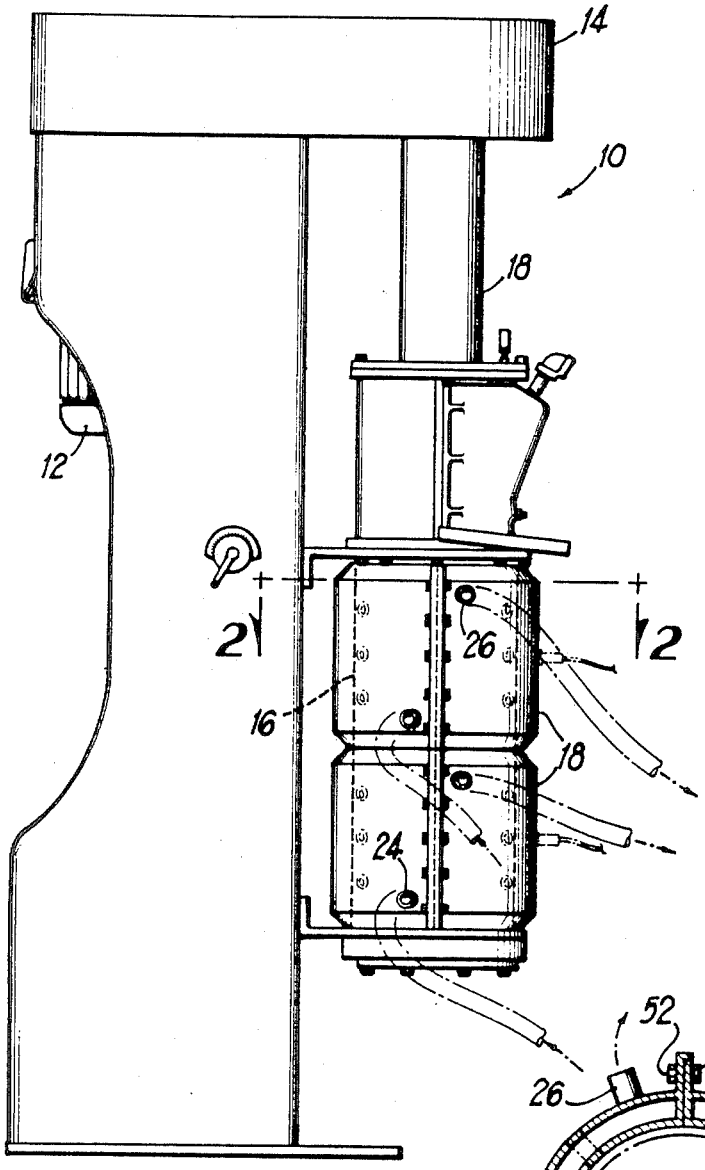
FIG. 1 is a perspective view of the present bladder-cooled chamber assembly, shown in installed position around a sandmill chamber vessel.
Figure 2:
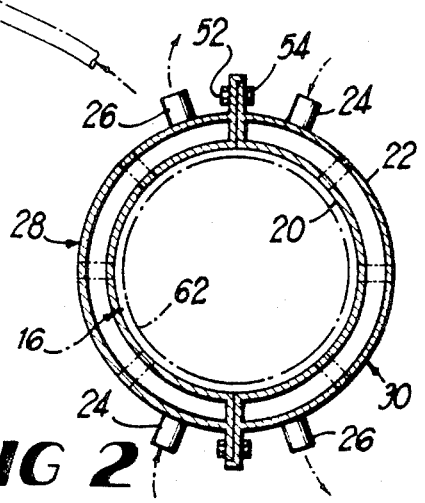
FIG. 2 is a cross-sectional view of the assembly, the section being taken on line 2—2 of FIG. 1.

Referring now more specifically to the drawings, and to FIG. 1 in particular, numeral 10 denotes generally a sandmill, which is a device used for stirring various substances, such as paint or clay/water slurries and the like. The sandmill is conventional in most respects and will not be described in detail; however, such devices generally include a power source or motor 12, a drive mechanism denoted generally by numeral 14, a solution mixing chamber 16, and a shaft 18 or other means which connects the drive mechanism to a mixing wand device or stirrer (not shown), disposed inside the mixing chamber 16.

Prior art sandmills normally have a cooling enclosure or jacket which is integrally formed with the actual mixing vessel, being separated only by the chamber wall. A fault in either the mixing vessel or the cooling jacket requires the shutdown, dismantling, and repair of the entire mixing/cooling vessel. If the fault occurs during use, a batch of mixed or partially mixed material may also be contaminated and lost.

The present invention avoids any such difficulties by virtue of its being added around the mixing vessel after assembly of the sandmill, and by its bladder-like construction. The bladders 18 of the present invention are self contained, each one having inner and outer walls, 20 and 22, respectively and inlet and outlet port means 24 and 26, respectively, for selective and individual control of cooling.

Each bladder 18 essentially consists of two self-contained symmetrical mating halves, 28 and 30, which are secured together along the corresponding and opposed vertical edge portions, here designated as 42 and 44, respectively. The opposite vertical edge portions 46 and 48, respectively, are secured in a similar manner, all having corresponding and opposed apertures 50 for receiving suitable securing means, such as bolts 52 and nuts 54. End portions 42 and 46 each have radially extending flanges 56 and 58 which receive the opposed end portions, facilitating assembly of the bladder. The inlet and outlet ports 24 and 26, respectively, may be connected to any suitable circulation device or pump 59, the cooling fluid normally being water. A possible arrangement is shown in phantom lines in FIG. 1, with hoses or pipes connected to the ports.

The invention will normally have an upper bladder assembly and a lower bladder assembly, depending on the height of the mixing vessel. Thus, as illustrated in FIG. 1, there are four, individual, enclosed bladders, two upper halves and two lower halves. This allows selective and economical cooling of the upper or lower portion of the vessel, the upper portion normally becoming hotter than the lower portion during operation of the sandmill. While described in upper and lower portions, the present invention may also be supplied as a single relatively long, bladder assembly, or the orientation may be horizontal, such refinements being considered as within and contemplated by the scope of this invention.

The bladder assembly is normally constructed of a corrosion-resistant material, for example, stainless steel, and the individual halves are symmetrical with respect to one another. Thus, for assembly of the bladders, any two halves may be mated and with either end up.

The circulation of water or other cooling fluid through the bladder assemblies, cools the mixing vessel and the contents therein, thereby prolonging the life of the vessel and protecting the charge therein. To facilitate the cooling process, a heat transfer or conductive paste 60, of any suitable type, may be applied to the outer circumferential surface 62 of the mixing vessel or to the adjacent inner circumferential surface 64 of the bladder.

Figure 3:
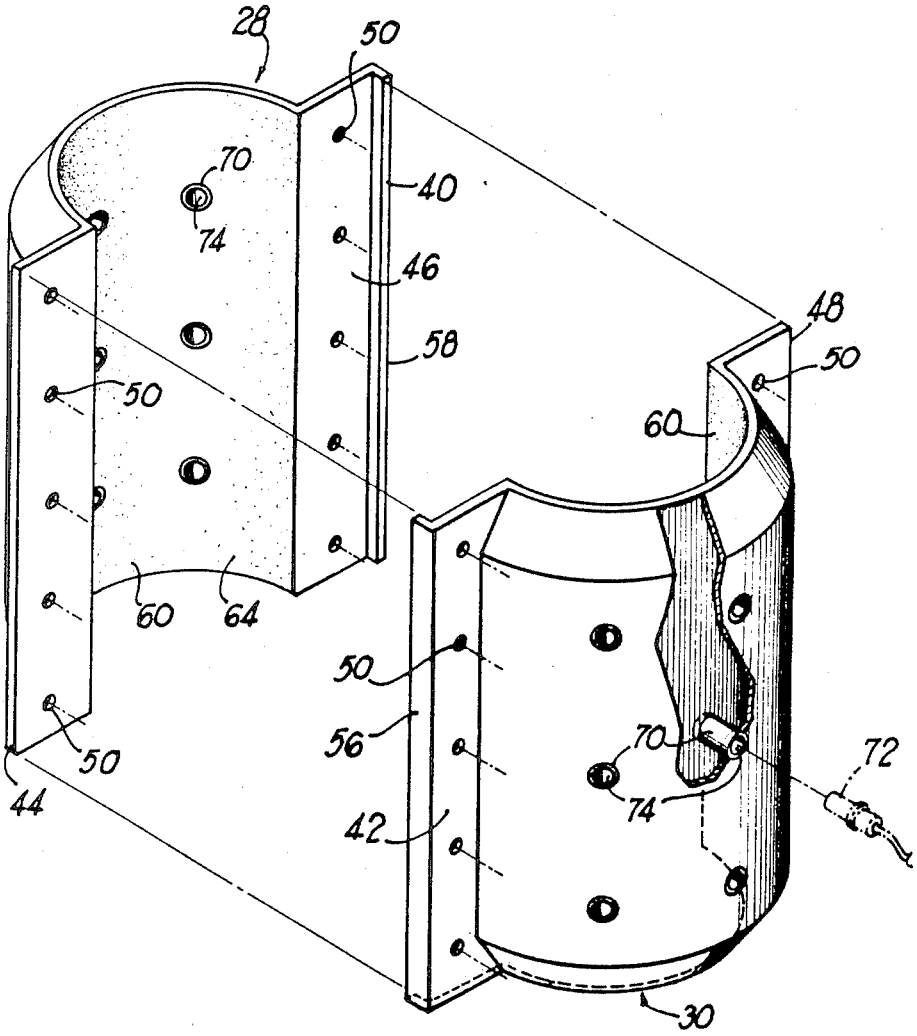
FIG. 3 is an exploded, perspective view of the bladder assembly, shown here apart from its installed position.

As shown in FIG. 3, a plurality of additional port means 70 may be cut or otherwise provided in the inner and outer walls of the bladder halves for accepting a thermocouple 72, or similar devices, and for promoting circulation of coolant through the bladder.

The ports 70 are provided with spacer means 74, such as a pipe section, which is welded or otherwise secured to the inner and outer walls of the bladder. These spacers ensure the separation of the inner and outer walls, preventing deformation thereof, and also enhance coolant circulation due to the "spoiler" effect on the coolant flow path. The increased turbulence provides a further increase in cooling efficiency over prior art cooling jackets. The units are pressure tested upon final assembly before installation around the mixing vessel.

The spaced locations of pipes 74 permit selective addition of conductive paste when desired to all sections of the chamber vessel wall and also allow the temperature to be checked at various levels during operation.

The bladder assembly shown and described herein may also be provided with auxiliary cooling devices (not shown), to further cool (or warm) the circulating fluid therein. Such plumbing methods can provide various degrees of cooling efficiency, depending on the charge being mixed in vessel or chamber 16.

Should a fault develop in either the mixing vessel or the present bladder assembly, the production run may normally be completed, with no damage to the charge in the mixing vessel. In sandmills with integral cooling jackets, a leak causes contamination of the product being mixed and/or the halting of the process for immediate repairs. The present bladder assembly, with the self-contained bladder members, avoids these difficulties since a leak in either component, the chamber or the bladder, does not affect the other, and the production run may be completed before repairs are made.

With the present invention, repairs to either the mixing chamber or to the bladder are easily accomplished by simply removing the individual halves of the bladder assembly. Should a leak develop in one bladder segment only, it is possible to continue operation of the sandmill while repairs to the bladder segment are made, appropriate adjustments being made for the lack or reduction of cooling. This possibility did not exist with prior art sandmills due to the integral nature of their construction. This also reduces by approximately one-half the cost of a replacement chamber, should one be necessary, due to the separate nature of the chamber 16 and the bladder assembly.

In the use and operation of the present cooling bladder assembly, heat conductive material may be applied to the outer wall of the mixing chamber vessel 16 or to the inner wall of the bladder halves. Any two, symmetrical, bladder halves are then moved into position around the mixing vessel, the end flanges 56 and 58 serving to help align the components. The sections are then secured together at the opposed vertical edges and the inlet and outlet ports are connected to a suitable coolant circulation system.

The invention thus provides superior cooling performance in an arrangement that is more economical to manufacture and operate than prior art systems. Installation and removal are easily accomplished and the present bladder assembly provides a long service life for the mixing vessel and the bladder itself.

While an embodiment of cooling bladder assembly for a mixing vessel and modifications thereof have been shown and described in detail herein, various additional changes and modifications may be made without departing from the scope of the present invention.

I claim:

1. A bladder cooled chamber assembly for installation around the mixing chamber of a sandmill or the like, comprising upper and lower pairs of bladder halves, each of said bladder halves having inner and outer walls forming a chamber therebetween, a coolant fluid disposed in said chamber, inlet and outlet port means formed in said outer walls in each of said bladder halves for ingress and egress of said coolant means, a pump means operatively connected with said port means for circulating said coolant throughout said chambers, each of said bladder halves having a flange means along one vertical edge thereof and a substantially flat opposite vertical edge, said flat edges being receivable within said flange means directly opposite thereto upon installation of said bladder halves, and securing means for fastening said opposed vertical edges together, and drawing said bladder halves tightly around the sandmill, whereby essentially all of the mixing chamber of the sandmill is enveloped therebetween.

2. A bladder-cooled chamber assembly as defined in claim 1, and including spacer means connected to said inner and outer walls for maintaining the integrity of said enclosure.

3. A bladder-cooled chamber assembly as defined in claim 2 in which said spacer means include pipe sections having open ends for access to the mixing chamber.

4. A bladder-cooled chamber assembly as defined in claim 3 in which said assembly includes a heat conductive paste means applied to the outer wall of the mixing chamber.

5. A bladder-cooled chamber assembly as defined in claim 4 in which said inner and outer walls are stainless steel.

6. A bladder-cooled chamber assembly for installation around the mixing chamber wall of a sandmill or the like, comprising a pair of bladder halves, each of said bladder halves having inner and outer walls forming a chamber therebetween, a coolant fluid disposed in said chamber, inlet and outlet port means formed in said outer walls for providing ingress and egress of said coolant means, a pump means operatively connected with said port means for circulating said coolant fluid throughout said chamber, spacer means in said chamber comprising pipe sections secured to said inner and outer walls and having open ends for disrupting the flow of said coolant and providing an access through said bladder halves, and each of said bladder halves having a flange means along one vertical edge thereof and a substantially flat surface along the other vertical edge, said flat surface edges being receivable within said flange means of the opposed bladder half, and securing means for fastening said opposed edges together and securing said bladder halves around the mixing chamber.

7. A bladder-cooled chamber assembly as defined in claim 6 in which said assembly includes a heat-conductive paste applied to said mixing chamber and to said bladder halves.

* * * * *